US009061435B1

(12) United States Patent
Proudfoot et al.

(10) Patent No.: US 9,061,435 B1
(45) Date of Patent: Jun. 23, 2015

(54) AUTOMATED KNIFE CHANGE ADJUSTMENT ON DUAL-GEARBOX PAPER CUTTING MACHINES

(75) Inventors: Jonathan B. Proudfoot, Mahopac, NY (US); Wayne T. Smith, San Rafael, CA (US)

(73) Assignee: Colter & Peterson, Inc., Paterson, NJ (US)

( * ) Notice: Subject to any disclaimer, the term of this patent is extended or adjusted under 35 U.S.C. 154(b) by 865 days.

(21) Appl. No.: 12/807,703

(22) Filed: Sep. 10, 2010

Related U.S. Application Data

(60) Provisional application No. 61/276,423, filed on Sep. 10, 2009.

(51) Int. Cl.
*B26D 7/26* (2006.01)

(52) U.S. Cl.
CPC ..... *B26D 7/2628* (2013.01)

(58) Field of Classification Search
USPC ..... 83/529, 530, 643; 100/257; 72/21.1, 72/446
IPC ..... B30B 15/0035,15/0041; B26D 7/2628
See application file for complete search history.

(56) References Cited

U.S. PATENT DOCUMENTS

| | | | | |
|---|---|---|---|---|
| 3,147,695 | A * | 9/1964 | Hyman | 100/257 |
| 3,272,050 | A * | 9/1966 | Barley | 83/390 |
| 3,858,432 | A * | 1/1975 | Voorhees et al. | 72/455 |
| 4,228,706 | A * | 10/1980 | Borzym | 83/320 |
| 4,301,723 | A * | 11/1981 | Borzym | 100/271 |
| 4,378,717 | A * | 4/1983 | Schneider et al. | 83/530 |
| 4,481,847 | A * | 11/1984 | Schneider et al. | 83/530 |
| 4,630,516 | A * | 12/1986 | Koch et al. | 83/530 |
| 5,349,902 | A * | 9/1994 | Daniel et al. | 100/48 |
| 5,678,446 | A * | 10/1997 | Futamura et al. | 72/404 |
| 6,619,088 | B1 * | 9/2003 | Oyamada et al. | 72/17.2 |

* cited by examiner

*Primary Examiner* — Kenneth E Peterson
(74) *Attorney, Agent, or Firm* — Thomas M. Freiburger

(57) ABSTRACT

An automated knife change adjustment on dual-gearbox paper cutting machines employs servo motors driving, with great gear reduction, turnbuckle nuts on a pair of pull arms. A graphic user interface automatically controls the knife adjustment on a replacement knife, the interface computer being connected to position sensors for the knife, to main motors driving gearboxes that cycle the knife down and up, to the servo motors and other sensors. The system avoids tedious manual steps typically in setting a replacement cutting knife to a correct cutting position.

5 Claims, 1 Drawing Sheet

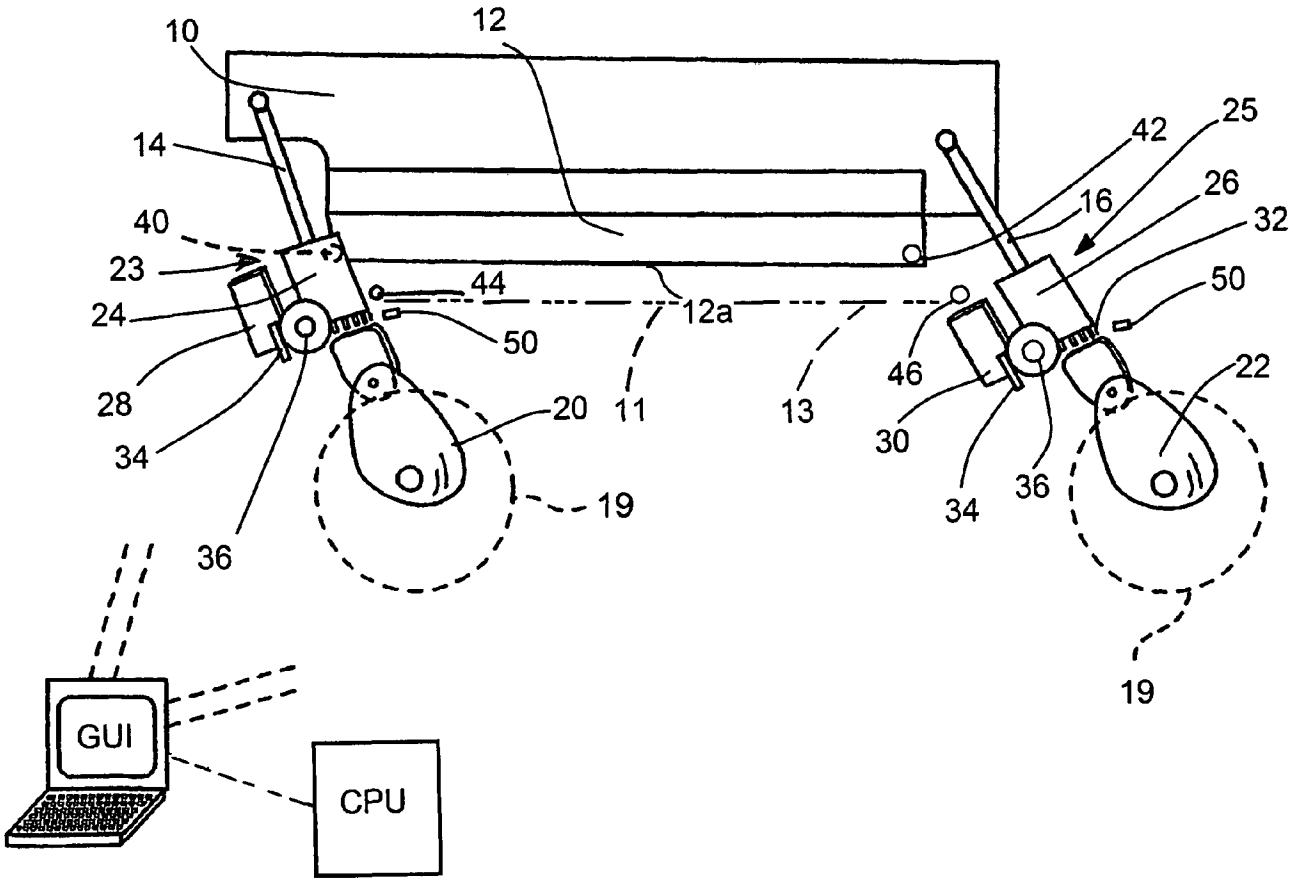
10
12
14
16
40
23
24
28
34
36
44
50
20
19
11
12a
13
46
30
34
36
42
25
26
32
50
22
19
GUI
CPU

AUTOMATED KNIFE CHANGE ADJUSTMENT ON DUAL-GEARBOX PAPER CUTTING MACHINES

This application claims priority from provisional application Ser. No. 61/276,423, filed Sep. 10, 2009.

BACKGROUND OF THE INVENTION

This invention is concerned generally with paper cutting machines, and more specifically paper cutting machines with dual knife pulldown rods driven by dual gearboxes. The invention automates the process of obtaining proper positioning of a paper cutting knife after a knife change.

On large paper cutting machines with cutting knives often three feet, four feet or wider, the cutting knife must be replaced with a sharpened knife after several thousand cuts, typically about 3,000 to 3,500 cuts. Typically the knife rides on a moving beam that descends toward the paper at an oblique angle (often about 45°) and which changes in orientation relative to the paper-supporting surface as it descends, from slightly non-parallel to parallel. The paper is pinched between the sharpened end of the knife and a "cutting stick" which is at the surface carrying the paper. The blade edge impinges only slightly into the surface of the cutting stick.

On the change of a paper cutting knife, the replacement knife will have a slightly different depth, i.e. height from top to bottom. The movement of the knife-holding beam is governed by pull arms near left and right ends of the beam, and both pull arm mechanisms must be adjusted to place the replacement blade edge at precisely the right height so that it cuts the paper properly, engaging properly against the cutting stick below during each cut.

Typically the operator uses a computer, a graphical user interface including a monitor, during the knife change. The user sets the system for a knife change and sends the knife down to the cutting stick. The knife-cutting beam will stop automatically at the bottom. The user removes two knife bolts at one side of the knife, then returns the beam and knife to the top position. At that point the cutting stick may be turned over or around for a new edge. The operator removes the remaining knife bolts, and again lowers the knife. He then removes the dull knife and places the sharp knife for lifting onto the beam. He can use a bolt key (used also to remove the bolts) to lift the sharp knife so that the bolts can be replaced. Once all bolts are loosely fitted, the operator tightens the center bolt.

From here, the operator has to more or less manually adjust the top position of the knife and bottom position of the knife, via the beam top and bottom positions and using the left and right pull arm mechanisms. This includes, after installing the new knife, raising the beam to the high point and then adjusting turnbuckles on the pull arms to set the knife at a position that will be somewhat high when the knife is lowered, then lowering the beam/knife and adjusting one side of the beam (e.g. the right side) to put the adjacent knife edge at a precise height relative to the cutting stick. Then the operator adjusts the opposite-side pull arm via its turnbuckle until the knife edge at that end engages the cutting stick precisely as desired. A test cut can then be made.

The adjustments of the pull arm turnbuckles in the typical conventional system required the operator to use wrenches for rotation of the turnbuckle nuts. The procedure for knife exchange tended to be time consuming and inconvenient for operators.

SUMMARY OF THE INVENTION

With the invention the knife change adjustment on a paper cutting machine having dual pull down rods is automated.

Adjustment of the pulldown rod turnbuckles is accomplished by motors, and positions are sensed and set automatically.

The operator follows the initial procedure outlined above for removal of a dull knife and placing a sharp knife on the beam, to the point of tightening the center bolt holding the knife on the beam. Following this, however, the operator now, following the invention, uses the graphical user interface to commence the automated raising of the beam and knife to the first initial top setting, using a key on the screen or keyboard, and the top position which is prescribed for the knife replacement and adjustment mode is automatically set. The operator then tightens the remaining accessible bolts, which can be done at the same time the automatic top setting is in operation. The mechanism for the automatic setting is explained below.

When the graphic user interface (GUI) screen gives a message that the top setting is finished, the user sends the knife to the bottom position. The knife will stop automatically at the lowest point, which will be slightly above the cutting stick. The user fits the two remaining left side bolts, now at an accessible position, and the automatic adjustment feature adjusts the knife edge, using the servo motors, to the precise prescribed position against the cutting stick. When the screen gives the operator a message that the setting of the knife to the cutting stick is complete, the user returns the knife to the top using "cut" buttons on the screen or keyboard. At that point, the operator makes a test cut to be sure the bottom sheet of paper is cut. He can use screen buttons of the GUI to adjust the knife edge lower if needed. The GUI enables the operator to choose increments of additional lowered position based on the test cut result.

The operator uses the GUI to indicate the knife change is complete, and the knife cut counter is reset to reflect that the knife has been replaced.

It is therefore a central object of the invention to automate the often time-consuming and inconvenient procedure of replacing a knife on a dual pull arm paper cutting machine, effecting automatic settings of knife positions using sensors, servo motors and a graphic user interface. These and other objects, advantages and features of the invention will be apparent from the following description of a preferred embodiment, considered along with the accompanying drawings.

DESCRIPTION OF THE DRAWINGS

The drawing FIGURE is a schematic elevation view indicating important components and automated knife change adjustment system for a dual pulldown rod paper cutting machine.

DESCRIPTION OF PREFERRED EMBODIMENTS

The drawing shows a portion of a paper cutting machine schematically, and indicating components according to the invention. The drawing shows a movable beam 10 on which is mounted a knife 12 which, in a cutting cycle, is moved downward, preferably at an oblique angle such as about 45°, into contact with a cutting stick which is set in a table or paper-supporting surface. The cutting stick and paper-supporting surface are both at the same level and in this schematic view the cutting stick is indicated by the dashed line at 13, while the paper-supporting surface is indicated in short dashes 11. The cutting is by pinching the paper between the knife edge **12*a* and the surface 13, with the cutting action enhanced by the angled motion of the knife edge as it descends (down and to the right as seen in the drawing). The beam follows a mechanism or track, not shown, defining its path downward for cutting, a mechanism well known in the industry. To the beam are connected two pivotally-secured pull arms 14 and 16 at left and right as shown. The pull arms operate at an angle approximately reflecting the direction of movement of the beam and knife. Each pull arm 14, 16 is operated by a fixedly mounted gearbox 19 rotating a crank 20 (left) and 22 (right) that achieves the pull-down motion. The crank 20 or 22 establishes the high point and the low point of the beam and blade. A turnbuckle 23, 25 with turnbuckle nut schematically shown at 24, 26 is included on each of the left and right pull arm assemblies for adjustment of the position of the beam, particularly the position of the knife edge 12***a* at its bottom-most position, for correctly pinching against the cutting stick. The turnbuckle comprises the turnbuckle nut, rotatable on threads (threads not shown). All of the apparatus described thus far is typical of a paper cutting machine with dual knife pulldown arms.

The invention adds position sensors, servo motors and an operating program to automate the knife adjustment procedure when a replacement knife is installed. At each side is an electric motor 28, 30 which ultimately drives rotation of the turnbuckle nut 24, 26 via a gear 32 on the turnbuckle. This gear is driven with extreme gear reduction, such as 100:1 and preferably greater, by a worm drive 34 from the motor, driving a pinion 36, which itself can be engaged with the turnbuckle gear 32 via worm drive. Thus, very fine adjustments can be made via this extreme gear reduction. The rotation of the adjusting nut 24, 26 of the turnbuckle, connected to the gear 32, will extend or retract the pull arm 14 or 16 with fine adjustment.

The system includes knife top sensors at left and right, schematically indicated at 40 and 42 in the drawing. These can be proximity sensors (e.g. induction sensors) or optical sensors or other precision sensors which indicate to the operating system or GUI when the knife blade edge 12*a* reaches a prescribed height. The electronic control system which includes the motors, reduction gearing and GUI software, adjusts the knife top height to the required knife change height as sensed by the upper sensors 40 and 42. The system roughly pre-adjusts this top height such that the knife edge will be about 3 mm above the cutting stick (not shown) when the beam and knife are in the lowered position. The control system (preferably under the control of the user, for safety) then sends the beam down to the lower position. The system ensures that the knife is stopped at the exact cycle bottom position so that the knife can be accurately adjusted to pinch the cutting stick correctly.

To ensure that the correct pinch setting is achieved, left and right lower sensors 44 and 46 preferably are positioned near the cutting stick to sense the knife edge 12*a* at the lower position, determining when the knife edge is at the correct pinch setting. In lieu of or in addition to the use of these sensors, the motor current of one or both motors 28, 30 can be sensed to indicate motor torque applied to the pull arm nut during setting, to determine the knife pinch setting on the cut stick, i.e. the amount of pressure of the knife as bearing against the cut stick. The pinch setting can be entered into the control system so that the amount of pinch or pressure into the cutting stick can be an adjustable preset value. The procedure of the system in using motor current as an indicator is to lower the knife 12 to a position where it is at bottom (via the gearboxes 19 and cranks 20, 22), which will be a position above the cutting stick by a slight amount, since this was set into the procedure by the top height adjustment. One of the pull arms, such as the right pull arm 16, can then be drawn to the point that the system senses that the right edge of the cutting knife is in contact with the cutting stick. This can be via the sensor 46 and the current in the right servo motor 30 driving the turnbuckle, or by the motor current alone. This can be a position of very slight contact with the cutting stick, since the subsequent lowering of the left side of the knife will bring down the right edge further by a slight amount (due to the pivot position as in the drawing). Then, the left drive motor 28 can be activated to pull down the left side of the knife via the pull arm 14, until the prescribed amplitude motor current draw is sensed, indicating the left side is at correct pinch setting. A further adjustment can be made via the right motor, if necessary.

The system preferably also includes a pull arm turnbuckle nut position sensor indicated at 50 (repeated on the left turnbuckle as well), to give an indication of the position in degrees or number of turns or notches of the pulldown adjustment nut, to give feedback to the control system. If an operator needs to make adjustments via the GUI as a final setting for the knife blade, he can enter a prescribed number of increments of movement of the turnbuckle nut or nuts, or an angle in degrees.

The control system has further inputs from the main HMI touchscreen to allow the operator to manually raise, through screen inputs, or further lower each side of the knife in the event changes to the setting are required once the knife edge has dulled but is not yet in need of replacement.

A software program is included in the system to control the motor functions for automatically setting the replacement knife to the cutting stick accurately, in the manner described above. The drawing shows a CPU (computer) connected to the GUI, although the GUI could be a unit including a computer processor.

Thus, the method of operation of the automatic knife change adjustment of the invention is as follows:

The knife is replaced with a sharp knife, as noted above, then the automatic setting takes place. This is instigated by the operator, who tells the GUI the knife is ready to be set to the cutting stick. The two knife-up sensors 40 and 42 are positioned to detect the knife-up position, both sensors being fixed to the frame of the machine (frame not shown). The right sensor 42 can be fixed to the clamp lower right front face, which is secured to the frame.

With the knife up, the program then checks that the knife is not covering either of the knife-up detectors 40, 42. If it covers either of the detectors, the motor for the relevant turnbuckle 24, 26 is activated to raise the knife to be just above the detection sensor 40, 42. If the sensor is not tripped at all, the program causes the motor to drive the knife down until detected, then to lift the knife back up until the knife tip is just above the sensor/detector.

The GUI now instructs the operator to send the knife beam and knife down to the bottom position (as noted above, for safety purposes the operator should be required to perform this function by activating a button on the screen or keyboard). The knife beam will lower the knife and will stop at the exact bottom position as caused by the cranks 20, 22, this being achieved by either a gearbox cam switch or encoder fitted to the gearbox 19 to determine the bottom-most position of the knife.

The left and right knife tip sensors 44 and 46 are at positions on the frame to detect when the knife tip is at the cutting stick. The system can employ only one such sensor, such as the right sensor 46, to detect when the right side of the knife tip is at the cutting stick. The left side can be governed by detection of motor current, as noted above.

When the computer receives information from the gearbox 19 that the knife has reached the exact bottom position (per the crank 22), the right lower detector 46 is checked to sense when the knife tip is detected; the right turnbuckle motor 30 is operated by the program as needed to lower the right knife tip setting until detected by this sensor.

Once the right side is detected the motor 30 may raise the right side of the knife slightly using the sensor 50 detecting rotational nut position of the turnbuckle 26, this raise value being held in the program. Now the left side turnbuckle motor 28 will lower the left knife tip until the motor control senses that more power (current), or a prescribed amount of increased power, is being consumed by the left motor, indicating that the left knife tip has contacted the cutting stick; alternatively, the left lower knife tip sensor 44, if included, could stop the motor 28's downward movement of the left side. Note that if desired, the motor power draw for both left and right turnbuckle motors 28 and 30 can be sensed while running the motors toward the downward position, until the precise amount of power draw is sensed, indicating the correct pinch of the knife against the cutting stick.

The GUI then asks the operator to return the knife to the top (home) position, and then to test the setting with some paper by making a test cut. If further adjustment is needed, the operator has access to buttons on the GUI screen to enable him to make small left or right side turnbuckle motor adjustments, as noted above. These can be by prescribed increments of movement.

Note that the turnbuckle system of the invention with the reduction gearing 34, 36 has the effect of holding the turnbuckle setting until the motor is operated, so that the turnbuckle nut position need not be tightened down or held in any other way.

The GUI or user interface is indicated schematically in the drawing. It is connected to all position sensors, to sensor motor current (power) draw sensors, if included, to the motors of the motor-driven gearboxes 19, to position encoders of the gearboxes 19 or cranks 20, 22, to the servo motors 28, 30, and to turnbuckle nut position sensors (encoders) if needed. GUI allows the operator to initiate steps and knife movements and fine adjustments as desired to the knife bottom position, as described above.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A paper cutting apparatus in which an elongated cutting knife mounted on a beam is lowered to contact with a cutting stick at a paper-supporting surface to cut sheets of paper, including an automated system for setting a replacement cutting knife on the paper cutting apparatus to a precise desired position against the cutting stick against which the knife blade engages, said paper cutting apparatus comprising:

a pair of pull arms including a left pull arm and a right pull arm connected to the beam which holds the cutting knife, the pull arms being oriented to move the beam and cutting knife on an oblique angle down toward the cutting stick and to return the beam and knife to a top position, each pull arm being connected via a length-adjusting turnbuckle to a rotatable crank that effects the lowering and raising movement cycle of the beam and knife, left and right motor-driven gearboxes, each being connected to rotate, when appropriate, one of the cranks connected to a respective pull arm to lower and raise the knife, left and right knife top position sensors positioned to generate a signal when the cutting edge of the cutting knife reaches a prescribed top height position at each side individually, and a knife lower sensor for determining when the edge of the cutting knife is at a prescribed lower setting, each of the turnbuckles connected in the left and right pull arms comprising a turnbuckle nut whose rotation effects length adjustment, and including, at each turnbuckle, a servo motor connected to the turnbuckle nut via a gear reduction device such that rotation of the servo motor rotates the turnbuckle nut with gear reduction in a selected direction for lengthening or shortening of the pull arm with fine adjustment, a turnbuckle nut rotation position sensor at each turnbuckle nut, a programmed computer with user interface connected to the top position sensors and lower sensor, to the motor-driven gearboxes, to the servo motors and to the turnbuckle nut rotation position sensors, the user interface being effective using programming to determine via the knife top position sensors when the cutting knife is moved by the cranks to a top position, to adjust the top position via the left and right turnbuckles as needed when a replacement knife has been placed on the beam, to determine when the cutting edge of the knife is at a prescribed lower position at the cutting stick, to automatically make adjustments of the lower position of the cutting edge of the knife via the servo motors and turnbuckles, to provide feedback to the computer as to turnbuckle nut rotational movement and position, and to allow a user of the user interface to make adjustments of the knife cutting edge position against the cutting stick as desired using the servo motors, turnbuckles, and said feedback from the nut rotation position sensor.

2. The apparatus of claim 1, wherein the reduction gearing from each servo motor to a turnbuckle nut includes worm gearing.

3. The apparatus of claim 1, wherein said turnbuckle nut rotation position sensor comprising an encoder that reads the position of rotation of the turnbuckle nut and records the position in the user interface, the user interface being connected to the encoder.

4. The apparatus of claim 1, wherein the knife lower sensors comprises an optical or proximity position sensor at the cutting stick.

5. The apparatus of claim 1, wherein the knife lower sensors comprise servo motor current draw sensors connected to the user interface for detecting at each of right and left sides of the knife a pinch pressure of the knife against the cutting stick when the knife is lowered against the cutting stick, so that the user interface can automatically adjust pinch pressure at each side using the servo motors.

* * * * *